US006062650A

United States Patent [19]

Smith et al.

[11] Patent Number: 6,062,650

[45] Date of Patent: May 16, 2000

[54] CONTINUOUS CONTROL SYSTEM FOR A MINING OR TUNNELLING MACHINE

[75] Inventors: Herbert A. Smith, Onaping; Jack R. Hayes, Dowling, both of Canada

[73] Assignee: Advanced Technology For Rock Excavation Inc., Onaping

[21] Appl. No.: 08/875,413

[22] PCT Filed: Jan. 30, 1996

[86] PCT No.: PCT/CA96/00058

§ 371 Date: Jul. 28, 1997

§ 102(e) Date: Jul. 28, 1997

[87] PCT Pub. No.: WO96/24753

PCT Pub. Date: Aug. 15, 1996

[30] Foreign Application Priority Data

Feb. 7, 1995 [CA] Canada ..... 2141984

[51] Int. Cl.[7] ..... E21C 35/24; E21C 35/08

[52] U.S. Cl. ..... 299/1.4; 299/1.8; 299/75

[58] Field of Search ..... 299/1.3, 1.4, 1.8, 299/73, 75, 76

[56] References Cited

U.S. PATENT DOCUMENTS

| | | | |
|---|---|---|---|
| 4,343,512 | 8/1982 | Heitkamp et al. | 299/1.3 |
| 4,470,635 | 9/1984 | Paurat et al. | 299/1.8 |

FOREIGN PATENT DOCUMENTS

| | | | |
|---|---|---|---|
| 0 040 078 | 11/1981 | European Pat. Off. . | |
| 0 204 429 | 12/1986 | European Pat. Off. . | |
| 0 221 886 | 5/1987 | European Pat. Off. . | |
| 24 58 514 | 6/1976 | Germany . | |
| 2 124 407 | 2/1984 | United Kingdom . | |
| 2133063 | 7/1984 | United Kingdom | 299/1.4 |
| WO 91/18184 | 11/1991 | WIPO . | |

*Primary Examiner*—David Bagnell
*Assistant Examiner*—John Kreck
*Attorney, Agent, or Firm*—George J. Primak

[57] ABSTRACT

A continuous control system for a mining or tunnelling machine having a boom (12) with a motor driven cutting head (14) at one of its ends and a rotatable turret (20) at the other end, the control system comprising angular encoders (40, 44) for continuously measuring the angles of the boom (12) and of the turret (20) and a linear encoder (55) for continuously measuring the linear position of the cutting head (14), and further having pressure transducers ($P_1$, $P_2$, $P_3$, $P_4$) for continuously measuring the pressures of the various hydraulic cylinders or drives (41, 43) used to operate the boom (12) and the turret (20). It may also have a power transducer (57) for continuously measuring the power input to the motor (18) driving the cutting head (14) to control the RPM of the latter. The signals from the above various measurements are continuously processed by a computer (46) in accordance with a predetermined computer program and a controller (47) is provided which is responsive to the computer (46) and which continuously controls the various parameters so as to cut a preselected profile at a predetermined depth of cut and rate of advance.

20 Claims, 3 Drawing Sheets

CONTINUOUS CONTROL SYSTEM FOR A MINING OR TUNNELLING MACHINE

TECHNICAL FIELD

This invention relates to a continuous control system for a mining or tunnelling machine having a tiltable boom with a rotatably driven cutting head at one end of said boom, projecting toward the face to be cut, and at its other end the boom being connected to a rotatable turret which also enables said boom to rotate. Such machines are generally known as heading machines or roadheaders or boom mining or tunnelling machines.

BACKGROUND OF THE INVENTION

Various control systems have in the past been proposed for mining or tunnelling machines. One such system, for example, is disclosed in International Patent Application (PCT) WO 91/18184 published Nov. 28, 1991. The machine disclosed therein is of a particular type with a large rotatable cutting wheel which is moved laterally as it rotates, thereby cutting a face having a height that essentially corresponds to the diameter of the cutting wheel. The control system of such a machine cannot be readily adapted to boom type mining or tunnelling machines wherein the boom is both tiltable and rotatable to achieve a desired profile of the cut, where "profile" means any path that the boom is directed to take, limited only by the mechanical constraints or the machine.

Other known systems provide for the cutting of a predetermined profile, but without a continuous control of the operation which enables appropriate corrections to be made as the face is being cut and while the machine is operating. Such known control systems are rudimentary in that control of individual movements (e.g. via control of individual hydraulic circuits or electric motors) is done in an essentially open-loop fashion, i.e. although there is some monitoring of the position of sump, boom and turret-rotation, the system is not able to react to that information other than in a discontinuous fashion. For profile cutting, a cam or a particular, simple cam algorithm for a given set of profile dimensions may be used to produce discrete, separate movements of boom and turret at certain distance intervals of movement of one or the other of boom-pivot or turret-rotation; this produces a profile accurate to within one or two degrees of movement of boom and/or turret (of the order of 3–5 cm. at best in terms of the profile itself). The lack of continuous control in known machines results in, not only inaccuracy of position and change of position (movement) in sump, boom-pivot and turret-rotate, but consequent with that inaccuracy, a great potential for variation in the rate of movement through the rock and thus a similar great potential for variation in forces experienced by the cutting head and tools. In hard rock cutting, for example, this lack of continuous and accurate control of position, movement and force results in, at best, an inaccurate profile and a much shortened tool life and, at worst, an almost total inability to penetrate and cut the rock. In very fractured ground, such uncontrolled cutting can also result in undesired blocks of rock being torn or pulled from the perimeter of an excavated opening, thus exacerbating ground control problems. A further disadvantage of the previous systems is that for any change in profile dimensions, an entirely new set of corresponding boom angle and turret angle values would have to be generated externally and then programmed into the machine computing system.

Thus, no satisfactory continuous control system appears to exist for a boom type machine such as mentioned above, wherein the boom is tiltable and rotatable and wherein the cutting head is also rotated using a separate motor or hydraulic drive for that purpose.

SUMMARY OF THE INVENTION

An object of the present invention is, therefore, to provide a novel continuous control system for a mining or tunnelling machine of the type referred to above, namely having a tiltable and rotatable boom and a cutting head rotated by a separate electric motor or hydraulic drive.

Another object of the invention is to optimize the control system so that proper corrections are continuously made to cut a preselected profile at a predetermined depth of cut and rate of advance.

Other objects and advantages of the invention will become apparent from the following description thereof.

Thus, in essence, the present invention provides a continuous control system for a mining or tunnelling machine having a boom with a cutting head which projects towards the face to be cut mounted at one end of the boom, and having means for rotating said cutting head at one or more RPM values, said boom, at its other end, being tiltably connected to a rotatable turret for rotation therewith, and means being provided for rotating said turret, the boom being tilted by means of at least one hydraulic cylinder with a piston slidable therein, said at least one hydraulic cylinder being connected at one end to the turret and at the other end to the boom so as to tilt the same when said piston is advanced out of or retracted into the hydraulic cylinder, said control system comprising:

- a first angular encoder for continuously measuring the tilt angle of the boom;
- a second angular encoder for continuously measuring the angle of rotation of the turret;
- a linear encoder for continuously measuring linear position of the cutting head;
- a computer responsive to output signals from said encoders configured to continuously process said signals according to a predetermined computer program; and
- a controller responsive to said computer, which controls proportional valve means which, in turn, control flow of hydraulic fluid into said at least one hydraulic. cylinder, and further controls the speed of rotation of the turret as well as the linear advance of the cutting head, thereby continuously controlling the boom angular position, the angular position of the turret and the linear position of the cutting head, so as to cut a preselected profile at a predetermined depth of cut and rate of advance.

In accordance with a preferred embodiment of the present invention, there is provided a continuous control system for a mining or tunnelling machine having a boom with an electric motor driven cutting head at one of its ends, said cutting head projecting toward the face to be cut and said boom, at its other end, being tiltably connected to a rotatable turret which is adapted to be rotated by means of hydraulic drives, thereby also rotating the boom as the turret is rotated, said boom being tiltable by means of at least one hydraulic cylinder with a piston slidable therein, said hydraulic cylinder being connected, at one end, to the turret and, at the other end, to the boom so as to tilt th e sa me when the piston is projected out of or retracted into the hydraulic cylinder , the control system comprising:

- a first angular encoder for continuously measuring the tilt angle of the boom;

a second angular encoder for continuously measuring the angle of rotation of the turret;

a linear encoder for continuously measuring the linear position of the cutting head;

means for measuring pressure of the hydraulic drives rotating the turret;

means for measuring pressure at each end of said at least one hydraulic cylinder used for tilting the boom;

means for selecting RPM of the electric motor driven cutting head;

a computer responsive to output signals from said encoders and said pressure measuring means, configured to continuously process said signals according to a predetermined computer program;

a controller responsive to said computer, which controls proportional valve means which, in turn, control flow of hydraulic fluid into said at least one hydraulic cylinder and into the turret hydraulic drives, and further controls linear advance of the cutting head, thereby controlling the boom angular position, the angular position of the turret and the linear position of the cutting head, said controls being continuously adapted to operate in accordance with the computer program so as to cut a preselected profile at a predetermined depth of cut and rate of advance.

The RPM of the cutting head may be pre-set at a constant rate or a variable speed drive may be provided to control said RPM at a variable rate. It should be noted that when the computer is used to control the variable speed drive, the speed, at any time, is set by the computer program acting on chosen and/or measured parameters, such as cutting head motor input power or boom vibration amplitude and/or frequency.

The continuous control system of the present invention may be used on machines wherein the rotatable turret is rotated about a horizontal axis or a vertical axis. In machines with turrets having a horizontal axis of rotation, these are followed by a non-rotatable housing wherein the hydraulic drives or motors for rotating the turret are mounted. This housing can be moved forward or back by means of sumping cylinders and means may be provided to measure hydraulic pressure therein, which may thus be used to control the linear position of the cutting head. The movement of the housing extends for a particular distance (e.g. one meter) while the machine is held stationary, for example by means of suitable stabilizing means, such as stakers, grippers, stells or stabilizers. Some machines have a telescopically extendable boom which would also provide a means of controlling the linear position of the cutting head. Such linear position can also be continuously measured by means of a suitable linear encoder the signals whereof are then sent to the computer and included in the computer program as one of the functions to be controlled.

Angular and linear encoders for continuously measuring the angular or linear positions are well known in the art. These are usually opto-electronic devices which provide readings every fraction of a second, for example ten to twenty times per second, which herein is called a continuous operation. The signals from the encoders are continuously transmitted to the computer and are processed thereby according to a preselected computer program, which can include suitable tables or algorithms. The term "encoder" as used herein is, therefore, a general term including any device suitable for performing continuous angular or linear measurements and transmission of the resulting signals to the computer.

The means for continuously measuring the various pressures consist of pressure transducers which are also well known in the art. With regard to the electric motor for driving the cutting head, it may be controlled by a variable speed drive. However, the RPM of the cutting head could also be pre-set by the operator at one or more RPM values and maintained essentially constant at that value. Of course, the RPM could also be continuously controlled by the computer and the variable speed drive as part of the overall program. The variable speed drive typically provides variable power to run the motor driving the cutting head at a rate of between about 3 and 10 RPM in hard or strong rocks and at what may be much higher rates in soft or weak rocks.

The controller normally comprises a plurality of PID (Proportional Integral Derivative) controllers which continuously control the various functions of the machine according to the instructions from the computer program. Preferably, the computer program is based on a mathematical algorithm which takes into account the various measured parameters and calculates the required conditions to achieve a desired profile at the best rate of advance while minimizing tool wear. This is normally done in a closed-loop operation.

The machines controlled in accordance with the present invention may operate with a hydraulic system which covers all rates of advance or with a hydraulic system composed of two or more sub-systems, each covering a distinct range of advance rates. Thus, a typical set-up for cutting hard ground may consist of a hydraulic sub-system to accurately allow advance rates of 20–100 mm/min, and a second sub-system to accurately allow advance rates of 100–1500 mm/min. The above mentioned advance rates refer to the linear advance of the cutting head. The control system of the present invention will, in such circumstances, provide two separate sets of valve means in parallel for the flow of hydraulic fluid into the boom cylinders and the turret hydraulic drives, one for the low rate of advance and one for the high rate of advance. This rate of boom advance can be represented by the following equation:

$$\text{RATE OF ADVANCE} = \text{DEPTH OF CUT/TOOL/REVOLUTION} \times \text{NUMBER OF TOOLS/LINE} \times \text{HEAD RPM}$$

The number and type of tools per line and the number of tool lines on the cutting head may vary depending on the machine and its desired use. The advantage of a hydraulic system with multiple sub-systems to cover different rates of advance is that individual componentry, specifically valves, can be chosen to operate within flow and pressure ranges over which they will perform most accurately.

Thus, in its preferred embodiment, the novel control system is a continuous, closed-loop, PID (Proportional, Integral Derivative) positional system whereby set-points ("should-be" values of boom-angle, turret-angle, and linear sump position) are continuously generated by a computer typically in the order of ten to twenty times per second (actual frequency depends on chosen componentry and calculation time, but it is fixed and known at any time); actual positional information on each of boom-angle, turret-angle and linear sump position is usually received at a frequency greater than set-point generation frequency, for example, greater than twenty times per second. The difference between actual and "should-be" values is continuously reacted to by the computing capability and by specifically chosen hydraulic drives, valves and pumps with the constant aim of driving that difference (error) to zero. This process is carried out for both individual movements of sump, turret-rotation and boom-pivot and for any combination of these movements. The result is a highly accurate, positional control system (typical error within about ±1 mm for linear sump and within about ±0.04 deg. for each of boom angle and turret angle); also, because the rate at which set-points are generated is constant and is very rapid, the system becomes a very accurate velocity control system for each movement or combination of movements and, thereby, for the end of the boom to which the cutting head is attached; and consequent with the accurate velocity of traverse of the cutting head and a (pre-set) constant rotational velocity of said head or controlled variable velocity, the depth of cut taken and the forces experienced by individual tools for that depth of cut in a given rock type are finely controlled as well. And, in very fractured ground, the disturbance to the perimeter of an opening is minimized. A further advantage of the new system is that, because a given profile is described mathematically within the machine computing system, different profiles or opening dimensions or shapes (including those shapes asymmetrical to the machine centre-line) can be initiated simply and rapidly by changing a very small number of numerical values within the computing system. The machine will then execute the new chosen path instructions automatically.

Another embodiment of the control system concerns the continuous monitoring of cutting head motor input power, and the hydraulic pressures in each of the sump, turret-rotate, and boom-pivot systems. This information may be used in several ways:

a) the setting of discrete levels of power and pressure, the exceedance of these levels for a chosen period of time automatically resulting in a specified reduction in the rate of positional change of the end of the boom (i.e. a reduction in head traverse velocity); this reduction in traverse rate requires those systems which are governing the rate (sump and/or turret-rotate and/or boom-pivot) to act in the same coordinated fashion as described above; this is achieved by the same manner of comparing required positional values and actual positional values on a continuous basis and constantly striving to drive the error to zero;

b) an extension to the above is the automatic resumption of the previous traverse rate or the adoption of some other rate if power and/or pressure values remain below a certain level for a specific period of time;

c) a further extension to the above is the continuous adjustment to the rate of change of the cutting head (boom-end) position as power and pressure levels are maintained at specific levels or within specified ranges.

A still further embodiment of the novel control system provides means for continuous monitoring of boom vibration amplitude and/or frequency, for instance through the use of accelerometers or velocity gauges placed on or adjacent to the boom, and automatic adjustment of boom traverse rate and/or cutting head speed to maintain said vibration amplitude and/or frequency within predetermined limits for the optimization of tool and machine component life.

A further extension to the control system of this invention provides means for continuous monitoring of tool temperature and/or tool force and the automatic adjustment of either or both of boom traverse rate and head speed to maintain the tool temperature and/or the tool force within predetermined limits for the optimization of tool life. The tool temperature may, for instance, be monitored using thermocouples and the tool force using strain gauges.

The computer program may, for example, be based on the following formulae which describe set-point generation for instances when the three modes of operation of the machine occur concurrently and a constant rate of change of position (i.e. constant velocity) of the boom is achieved. The instances cited are horizontal profiling with sump, and vertical profiling with sump (profiling involves both rotation of the turret and movement of the boom-pivot).

Basis

Accept that resultant boom velocity, $V \approx \sqrt{VP^2+VS^2}$ where VP=Profiling velocity of boom and VS=Sumping velocity of boom Choose "V", and ratio desired between VP and VS (say "N") then, $$V = \sqrt{VP^2 + (VP/N)^2} = \sqrt{VP^2(1+1/N^2)} = VP\sqrt{1+1/N^2}$$

$$VP = V \Big/ \sqrt{1+1/N^2}$$

$$\text{and } VS = VP/N$$

Set-Point Generation

1) Horizontal Motion

Rotation Set-point given by:

$$\phi_1 = \tan^{-1}\frac{(r\sin(\beta_o+\beta_c))}{(y)} \quad \text{where } \beta_c = \frac{360\ VP}{2\pi rF}$$

Elevation set-point given by:

$$\theta_1 = \sin^{-1}(y/L\cos\phi)$$

Sump set-point given by:

$$A_1 = A + VS/F$$

2) Vertical Motion

Rotation set-point given by:

$$\phi_1 = \tan^{-1}\frac{(x)}{(r\sin(\alpha_o+\alpha_c))} \quad \text{where } \alpha_c = \frac{360\ VP}{2\pi rF}$$

Elevation set-point given by:

$$\theta_1 = \sin^{-1}(x/L\sin\phi)$$

and Sump set-point given by $$A_1 = A + VS/F$$

Where:

$\phi$ is present turret angle $\phi_1$ is turret angle set point $\theta_1$ is elevation angle set point L is boom length F is set point generation frequency A is present sump position $A_1$ is sump position set-point and, for Horizontal Motion:

r is radius of great circle described by horizontal motion of cutting head y is vertical distance between plane of great circle and boom pivot point $\beta_o$ is present angle within great circle of boom projection on to horizontal plane $\beta_c$ is angular change within great circle per interval of time between set points and, for Vertical Motion:

r is radius of great circle described by vertical motion of cutting head x is horizontal distance between plane of great circle and boom pivot point $\alpha_o$ is present angle within great circle by boom projection on to vertical plane $\alpha_c$ is angular change within great circle per interval of time between set points.

On the basis of the above equations a suitable algorithm is provided to configure the computer for controlling the operation of the machine.

BRIEF DESCRIPTION OF THE DRAWINGS

A preferred embodiment of the invention will now be described with reference to the appended drawings, in which.

DETAILED DESCRIPTION OF THE INVENTION

Figure 1:
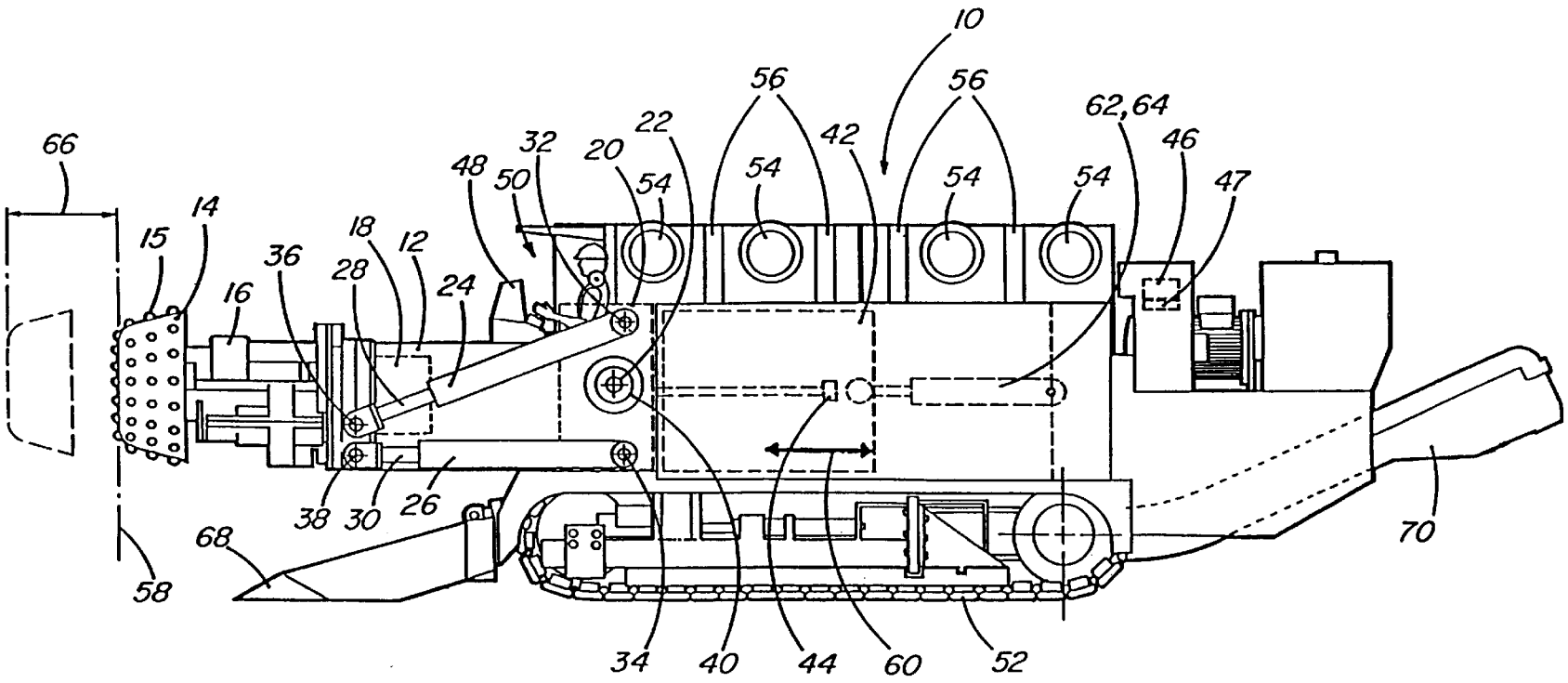
FIG. 1 is side-elevation view of a machine that may be controlled in accordance with the present invention.

Referring to FIG. 1, it shows a machine 10 that may be provided with a control system of the present invention. This machine has a boom 12 at one end of which there is a cutting head 14 which is connected to the boom 12 through a cutting head gearbox 16. Cutting head 14 has cutting tools 15 and is driven through the gearbox 16 by a motor 18 which rotates the cutting head at a desired speed, for example between 3 and 10 RPM for hard rock cutting. At the other end, said boom 12 is connected to a rotatable turret 20 and can be tilted on the boom pivot 22 by means of hydraulic cylinders 24 and 26 having pistons 28 and 30 slidable therein. At one end these hydraulic cylinders are connected to the turret 20 at points 32 and 34 and at the other end to the boom 12 at points 36 and 38, so as to tilt the boom 12 when the piston 28 either retracts or extends and piston 30 either extends or retracts into/from their respective cylinders 24, 26. The tilt of the boom 12 typically varies between 0 and 43° in such machines, but this is by no means limitative. The tilt angle of the boom 12 is continuously measured by an angular encoder 40 normally located at the boom pivot 22.

The rotatable turret 20 is followed by a non-rotatable housing 42 where the hydraulic drives for rotating the turret are located. An angular encoder 44 is provided to continuously measure the angle of rotation of the turret 20 and thus of the boom 12 on said turret. This angle is measured with reference to a predetermined line, usually the vertical axis of the turret 20, and can vary from 0 to 360°. The computer and controller system 46, 47 is normally located at the back of the machine, however the operator interface 48 may be provided in the operator station 50. The machine moves on crawler tracks 52, however this type of machine can also be fixed laterally to the walls by side stakers 54 and to the roof by stakers 56 to provide stability during operation. In such circumstances, to advance the cutting head 14 during cutting of the rock face 58, the housing 42 is advanced by a predetermined distance, e.g. 1 meter, as shown at 60, using sumping cylinders 62, 64 which may be achieved in two separate 0.5 m movements. The same distance is shown at the front for head advance 66. Once this stroke or advance is achieved and the whole of the face area is cut, the stakers 54, 56 are released, the housing 42 is brought back to its starting position, the machine is advanced on tracks 52 by the above predetermined distance, and the cutting process is begun again. The advance of the housing 42 and thus of the head 14 is also continuously monitored through a linear encoder and used by the computer to provide the necessary pressure on the rockface 58 during the cutting operation. The machine is also provided with a loading apron 68 with suitable gathering arms to load the rock which is being cut, which rock is then moved by means of conveyor 70 to the back of the machine to be hauled away.

Figure 2:
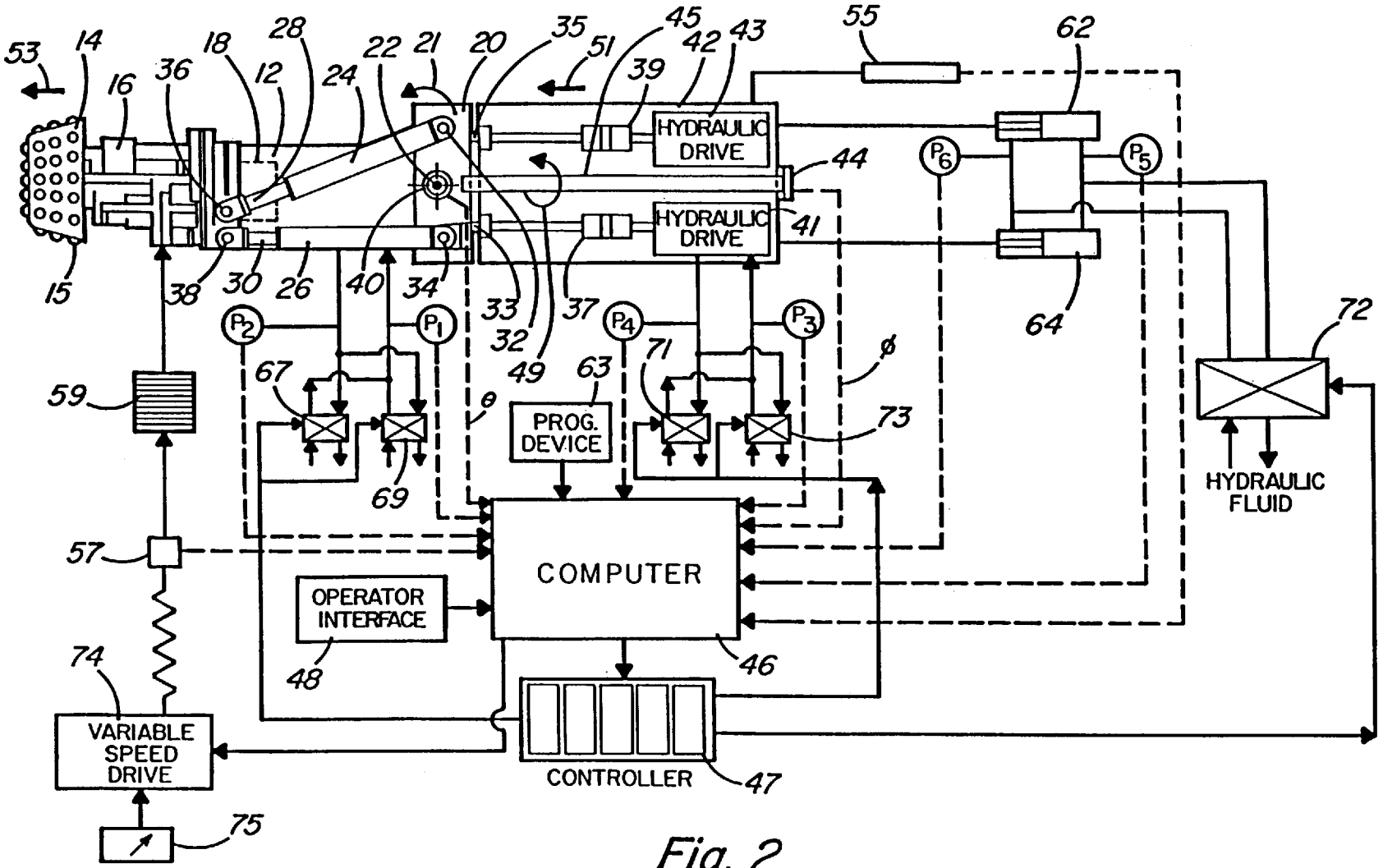
FIG. 2 is a diagrammatic illustration of a preferred embodiment of the novel control system for the machine of FIG. 1.

Referring to FIG. 2 wherein the same features are represented by the same reference numbers as in FIG. 1, it shows boom 12 at one end of which there is provided the cutting head 14 connected to the boom 12 through a gear box 16. The cutting head 14 is provided with cutting tools 15, such as picks or discs. Electric motor 18 is used to drive head 14 at a predetermined speed which can be constant or variable.

At its other end, the boom 12 is tiltably connected to turret 20 which, in this case, is shown to be rotated in the direction of arrow 21. It can also be rotated in the opposite direction, if desired. The tilting of the boom 12 is done about the boom-pivot 22 by means of hydraulic cylinders 24, 26 having pistons 28, 30 projecting therefrom. These cylinders are attached at one end to the rotatable turret 20 at points 32, 34 and at the other end, through the pistons 28, 30, to the boom 12 at points 36, 38.

Following the rotatable turret 20, there is provided a non-rotatable housing 42 which is also sometimes called a non-rotatable part of the turret. Hydraulic drives 41, 43 are mounted in housing 42; they rotate turret 20 in the direction of arrow 21. This is done through gear boxes 37, 39 and pinions 33, 35 engaging a single large slew ring adjacent to pinions 33, 35 which rotates the turret. There are typically four hydraulic drives used for this purpose. Turret 20, in turn, rotates shaft 45 in the direction of arrow 49, the same as that of arrow 21.

Housing 42 is linearly movable in the direction of arrow 51 (or in opposite direction, if desired) while the machine is maintained stationary. This is done by means of hydraulic cylinders 62, 64, which are usually called sumping cylinders. In this manner the cutting head 14 can also be moved in the same direction as shown by arrow 53.

The control of the excavation by the cutting head 14 is carried out as follows:

a first angular encoder 40 is provided at the boom pivot 22 to continuously measure the tilt angle of the boom 12;

a second angular encoder 44 is provided at the end of shaft 45 to continuously measure the rotating angle of turret 20, which normally rotates very slowly, for example, less than two complete rotations may be required in excavating an entire face or opening to one depth of the cutting head;

a linear encoder 55 is provided to continuously measure the linear position of the housing 42 and thus of the cutting head 14;

pressure transducers $P_1$ and $P_2$ are provided to continuously measure the pressure at each end of at least one hydraulic cylinder (e.g. 26) used for tilting the boom 12;

pressure transducers $P_3$ and $P_4$ are also provided to continuously measure the pressure at each end of the hydraulic drives 41, 43 which are used to rotate the turret 20;

pressure transducers $P_5$ and $P_6$ are used to continuously measure the pressure at each end of sumping cylinders 62, 64 which are used to move housing 42 in the linear direction of arrow 51 and thus to move head 14 in the same direction as represented by arrow 53; and power transducer 57, shown adjacent to slip-ring assembly 59, is used to measure the power input to motor 18 which drives head 14.

The signals from all above measuring devices are transmitted to the computer 46 as indicated by broken lines in FIG. 2. A suitable program or algorithm is input into the computer by program device 63 and the desired program for a given rock hardness or a given excavating speed or the like may be selected by the operator through operator interface 48. The computer processes the various signals in accordance with the preselected program on a continuous basis (e.g. ten to twenty time per second) and sends, also on a continuous basis, instructions to controller 47, usually consisting of a plurality of PID controllers which control the various functions of the machine.

Thus, for the twin hydraulic system cited earlier, the controller will control the hydraulic fluid input and output into valve 67 or 69 depending on whether the advance is carried out at a low rate or a high rate and this will control the tilt angle $\theta$ of boom 12 at any given time. The same control will be performed on hydraulic drives 41, 43 by controlling hydraulic fluid input and output into valves 71 or 73 again depending on the rate of advance. This will control the rotational angle $\phi$ of the turret 20 at any given time. With these two controls, a desired profile can be cut with great precision.

The rate of sumping advance can be controlled by continuously controlling the hydraulic fluid input and output into valve 72 which in turn will control the operation of cylinders 62 and 64 producing a desired advance rate of the housing 42 and thus of the cutting head 14.

Finally, the computer may also control the speed of rotation of the cutting head 14 through a variable speed drive 74. It should also be noted that this is an optional control feature since the speed of rotation of the head 14 may also be pre-set to run at a desired constant RPM. As can be seen from FIG. 2, the control system of the present invention provides a continuous, closed-loop control of the machine which enables it to cut a preselected profile at a predetermined depth of cut and rate of advance.

Furthermore, to provide such automatic and continuous control, the various pressures, such as $P_1$, $P_2$, $P_3$, $P_4$, $P_5$ and $P_6$ may be programmed to operate within predetermined limits and if, for example, these limits are exceeded in one or more instances, the computer will adjust some other function, e.g. reduce the rate of advance, in order that the predetermined limits be reinstated. This enables the machine to operate at the best rate of advance while minimizing tool wear for any given rock type or other situation.

Figure 3:
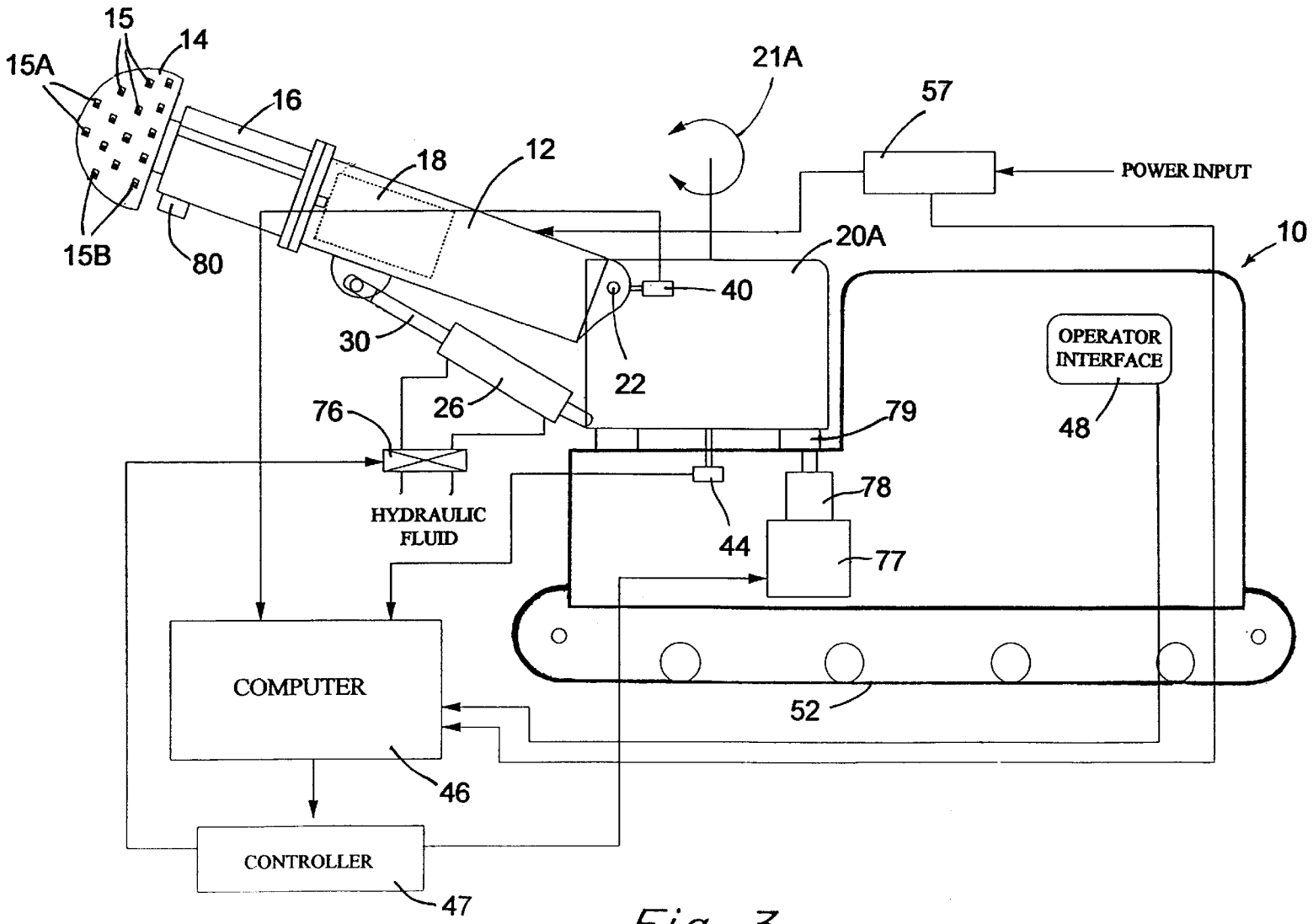
FIG. 3 is a side-elevation view of a machine according to the present invention having a turret rotatable about a vertical axis and other controls.

It should be understood that the invention is not limited to a control system for machines such as illustrated in FIG. 1. There are a number of machines which have a vertical axis rotatable turret to which the boom is tiltably connected. The novel control system can be readily adapted to such machines as well as illustrated in FIG. 3 where turret 20A rotates about a vertical axis as shown by arrow 21A. Angular encoder 44 is provided to continuously measure the angle of rotation of the turret 20A and thus of the boom 12. As previously described with reference to FIG. 1 and FIG. 2 such measurements are monitored by the computer and controller system 46, 47 which is normally accessed through operator interface 48. Also, as indicated previously, boom 12 can be tilted on the boom pivot 22 by means of the combination of hydraulic cylinder 26 and piston 30 operated through hydraulic proportional valve 26. Angular encoder 40 is provided at the boom pivot 22 to continuously measure the tilt angle of the boom 12. In this embodiment, turret 20A is operated by electric motor 77 in lieu of previously shown hydraulic drives 41, 43, A speed reducing gear box 78 connects the motor 77 to a slew ring drive 79 to rotate turret 20A. Also as previously described with reference to FIG. 1 and FIG. 2, boom 12 is connected to cutting head 14 via gear box 16 which is driven by electric motor 18 and power transducer 57 is used to measure the power input to the motor 18. The boom vibration amplitude and/or frequency can be measured by accelerometer 80. The cutting head 14 is provided with cutting tools 15, such as picks or discs. Some of these cutting tools, for example those designated as 15A, may be provided with thermocouples to monitor tool temperature and others, for example those designated as 15B, may be provided with strain gauges to monitor tool force. Also, there are machines with telescopic booms to provide the sumping action and the novel control system can again be readily used with such machines. Moreover, there are machines having two or more booms instead of one and the control system of the present invention will equally be applicable to such machines with minor obvious adjustments. Furthermore, the electric motor driving the cutting head could be replaced by a hydraulic drive. In such a case means would be provided to measure the pressure of said drive and the resulting output signals would be processed by the computer as already described with reference to hydraulic drives driving the turret. Also, there may be machines where the turret is driven by electric motors rather than hydraulic drives; such machines can equally be controlled using the control system of the present invention, whereby in lieu of measuring the pressure of the hydraulic drives, means would be provided to measure the power input to and RPM of the electric motors and the resulting signals would be processed by the computer essentially as already described with reference to the electric motor used for driving the cutting head.

Finally, referring to FIG. 2, it should be noted that not all machines and all operations will necessarily require all the measurements and controls indicated therein. Some machines will not require two rates of advance and some may require only one pressure measurement at the various cylinders and valve means, instead of two illustrated in the present case. All will depend on the desired accuracy of operation and the use to which the machine will be subjected. In other cases, one may wish to control some additional functions such as, for example, boom vibration amplitude and/or frequency or tool temperature and/or tool force, or roof staker and side staker cylinder pressures. Thus, many modifications obvious to those skilled in the art may be made without departing from the spirit of this invention and the scope of the following claims. Obviously, also, any machine having the novel continuous control system is within the scope of the present invention.

We claim:

1. A continuous control system for a mining or tunnelling machine having a boom with a cutting head which projects toward the face to be cut mounted at one end of the boom, and having means for rotating said cutting head at one or more RPM values, said boom, at its other end, being tiltably connected to a rotatable turret for rotation therewith and means being provided for rotating said turret, the boom being tilted by means of at least one hydraulic cylinder with a piston slidable therein, said at least one hydraulic cylinder being connected at one end to the turret and at the other end to the boom so as to tilt the same when said piston is advanced out of or retracted into the hydraulic cylinder, said control system comprising:

a first angular encoder for continuously measuring the tilt angle of the boom;

a second angular encoder for continuously measuring the angle of rotation of the turret;

a linear encoder for continuously measuring linear position of the cutting head;

a computer responsive to output signals from said encoders configured to continuously process said signals according to a predetermined computer program; and a controller responsive to said computer, which controls proportional valve means which, in turn, control flow of hydraulic fluid into said at least one hydraulic cylinder, and further controls the speed of rotation of the turret as well as the linear advance of the cutting head, thereby continuously controlling the boom angular position, the angular position of the turret and the linear position of the cutting head, so as to cut a preselected profile at a predetermined depth of cut and rate of advance.

2. A control system according to claim 1, wherein the means for rotating said cutting head comprise a hydraulic drive, and means are provided for measuring pressure of said hydraulic drive, with the computer being responsive to output signals from said pressure measuring means to continuously process said signals according to a predetermined computer program.

3. A control system according to claim 1, wherein a variable speed drive is provided to control the RPM of the cutting head, with the computer continuously controlling said variable speed drive according to a predetermined computer program.

4. A control system according to claim 1, wherein the means for rotating said turret comprise electric motors, and means are provided to measure power input to and RPM of said electric motors, with the computer being responsive to output signals from said power and RPM measuring means to continuously process said signals according to a predetermined computer program.

5. A control system according to claim 1, further comprising means for continuous monitoring of tool temperature and/or tool force on the cutting head, with the computer being responsive to said monitoring so as to continuously adjust the tool temperature and/or tool force values, to maintain the same within predetermined limits for the optimization of tool life.

6. A control system according to claim 1, further comprising means for continuously monitoring boom vibration amplitude and/or frequency, with the computer being responsive to said monitoring so as to maintain the boom vibration amplitude and/or frequency values within predetermined limits, for the optimization of tool and machine component life.

7. A control system according to claim 1, wherein the controller consists of a plurality of PID controllers.

8. A control system according to claim 1, wherein the computer is configured to provide a closed-loop operation, continuously using signals from the various measured parameters and continuously calculating the required conditions to achieve a desired profile at the best rate of advance while minimizing tool wear, and continuously transmitting appropriate commands to the controller.

9. A continuous control system for a mining or tunnelling machine having a boom with an electric motor driven cutting head at one of its ends, said head projecting toward the face to be cut and said boom, at its other end, being tiltably connected to a rotatable turret which is adapted to be rotated by means of hydraulic drives, thereby also rotating the boom as the turret is rotated, said boom being tiltable by means of at least one hydraulic cylinder with a piston slidable therein, said at least one hydraulic cylinder being connected at one end to the turret and at the other end to the boom so as to tilt the same when said piston is projected out of or retracted into the hydraulic cylinder, said control system comprising:

a first angular encoder for continuously measuring the tilt angle of the boom;

a second angular encoder for continuously measuring the angle of rotation of the turret;

a linear encoder for continuously measuring linear position of the cutting head;

means for measuring pressure of the hydraulic drives rotating the turret;

means for measuring pressure at each end of said at least one hydraulic cylinder used for tilting the boom; and means for selecting RPM of the electric motor driven cutting head;

a computer responsive to output signals from said encoders and said pressure measuring means, configured to continuously process said signals according to a predetermined computer program; and a controller responsive to said computer, which controls proportional valve means which, in turn, control flow of hydraulic fluid into said at least one hydraulic cylinder and into the turret hydraulic drives, and further controls linear advance of the cutting head, thereby continuously controlling the boom angular position, the angular position of the turret and the linear position of the cutting head, so as to cut a preselected profile at a predetermined depth of cut and rate of advance.

10. A control system according to claim 9, wherein the machine operates in a plurality of ranges of rate of advance and wherein the proportional valve means which control the flow of hydraulic fluid into the boom cylinders and into the turret hydraulic drives, consist of several sets of valves in parallel, each set being used for a different range of rate of advance of the machine.

11. A mining or tunnelling machine having a boom with a cutting head which projects toward the face to be cut mounted at one end of the boom, and having means for rotating said cutting head at one or more RPM values, said boom, at its other end, being tiltably connected to a rotatable turret for rotation therewith and means being provided for rotating said turret, the boom being tilted by means of at least one hydraulic cylinder with a piston slidable therein, said at least one hydraulic cylinder being connected at one end to the turret and at the other end to the boom so as to tilt the same when said piston is advanced out of or retracted into the hydraulic cylinder, said machine having a continuous control system comprising:

a first angular encoder for continuously measuring the tilt angle of the boom;

a second angular encoder for continuously measuring the angle of rotation of the turret;

a linear encoder for continuously measuring linear position of the cutting head;

a computer responsive to output signals from said encoders configured to continuously process said signals according to a predetermined computer program; and a controller responsive to said computer, which controls proportional valve means which, in turn, control flow of hydraulic fluid into said at least one hydraulic cylinder, and further controls the speed of rotation of the turret as well as the linear advance of the cutting head, thereby continuously controlling the boom angular position, the angular position of the turret and the linear position of the cutting head, so as to cut a preselected profile at a predetermined depth of cut and rate of advance.

12. A mining or tunnelling machine according to claim 11, having a turret rotatable about a horizontal axis followed by a non-rotatable housing where means are mounted for rotating said turret.

13. A mining or tunnelling machine according to claim 12, in which the linear position of the cutting head is continuously adjusted by means of sumping cylinders which move the non-rotatable housing in a linear direction, which position is measured by the linear encoder, said adjustment being done through valve means controlled by the controller.

14. A mining or tunnelling machine according to claim 11, which is further provided with stabilizing means to enhance the stability of the machine during the cutting operation.

15. A mining or tunnelling machine according to claim 11, having a turret rotatable about a vertical axis.

16. A mining or tunnelling machine having a boom with an electric motor driven cutting head at one of its ends, said head projecting toward the face to be cut and said boom, at its other end, being tiltably connected to a rotatable turret which is adapted to be rotated by means of hydraulic drives, thereby also rotating the boom as the turret is rotated, said boom being tiltable by means of at least one hydraulic cylinder with a piston slidable therein, said at least one hydraulic cylinder being connected at one end to the turret and at the other end to the boom so as to tilt the same when said piston is projected out of or retracted into the hydraulic cylinder, said machine having a continuous control system comprising:

a first angular encoder for continuously measuring the tilt angle of the boom;

a second angular encoder for continuously measuring the angle of rotation of the turret;

a linear encoder for continuously measuring linear position of the cutting head;

means for measuring pressure of the hydraulic drives rotating the turret;

means for measuring pressure at each end of said at least one hydraulic cylinder used for tilting the boom; and means for selecting RPM of the electric motor driven cutting head;

a computer responsive to output signals from said encoders and said pressure measuring means, configured to continuously process said signals according to a predetermined computer program; and a controller responsive to said computer, which controls proportional valve means which, in turn, control flow of hydraulic fluid into said at least one hydraulic cylinder and into the turret hydraulic drives, and further controls linear advance of the cutting head, thereby continuously controlling the boom angular position, the angular position of the turret and the linear position of the cutting head, so as to cut a preselected profile at a predetermined depth of cut and rate of advance.

17. A mining or tunnelling machine according to claim 16, having a turret rotatable about a horizontal axis followed by a non-rotatable housing where means are mounted for rotating said turret.

18. A mining or tunnelling machine according to claim 17, in which the linear position of the cutting head is continuously adjusted by means of sumping cylinders which move the non-rotatable housing in a linear direction, which position is measured by the linear encoder, said adjustment being done through valve means controlled by the controller.

19. A mining or tunnelling machine according to claim 16, which is further provided with stabilizing means to enhance the stability of the machine during the cutting operation.

20. A mining or tunnelling machine according to claim 16, having a turret rotatable about a vertical axis.

* * * * *